US012503836B2

(12) United States Patent
Lu et al.

(10) Patent No.: US 12,503,836 B2
(45) Date of Patent: Dec. 23, 2025

(54) BULLDOZER PLANNING AND CONTROL

(71) Applicant: AIM Intelligent Machines, Inc., Monroe, WA (US)

(72) Inventors: Devin Lu, Sunnyvale, CA (US); Jonathan D. Hurwitz, Seattle, WA (US)

(73) Assignee: AIM Intelligent Machines, Inc., Redmond, WA (US)

( * ) Notice: Subject to any disclaimer, the term of this patent is extended or adjusted under 35 U.S.C. 154(b) by 176 days.

(21) Appl. No.: 18/470,275

(22) Filed: Sep. 19, 2023

(65) Prior Publication Data

US 2025/0052039 A1 Feb. 13, 2025

Related U.S. Application Data

(60) Provisional application No. 63/518,238, filed on Aug. 8, 2023.

(51) Int. Cl.
*E02F 9/26* (2006.01)
*E02F 3/84* (2006.01)

(52) U.S. Cl.
CPC ..... *E02F 9/262* (2013.01); *E02F 3/847* (2013.01)

(58) Field of Classification Search
CPC ..... E02F 9/262; E02F 3/847
See application file for complete search history.

(56) References Cited

U.S. PATENT DOCUMENTS 4,888,890 A 12/1989 Studebaker et al.
5,682,311 A 10/1997 Clark
10,066,367 B1 * 9/2018 Wang ..... E02F 9/262
11,346,080 B1 5/2022 Kikani et al.
2002/0162668 A1 * 11/2002 Carlson ..... E02F 9/26 172/1
2009/0056961 A1 3/2009 Gharsalli et al.
2009/0178816 A1 7/2009 Piekutowski et al.
2010/0299031 A1 11/2010 Zhdanov et al.
2014/0032030 A1 * 1/2014 Stratton ..... E02F 9/2025 701/33.9
2014/0229079 A1 * 8/2014 Stratton ..... E02F 9/2029 701/33.9
2015/0375232 A1 12/2015 Loijas et al.
2016/0312446 A1 10/2016 Pettersson et al.
2016/0321763 A1 11/2016 Shike
2018/0258610 A1 * 9/2018 Elkins ..... E02F 3/841
2020/0299924 A1 9/2020 Kurokawa et al.
(Continued)

FOREIGN PATENT DOCUMENTS

WO WO-2022271512 A1 12/2022
WO WO-2025034718 A1 2/2025
WO WO-2025054304 A1 3/2025

OTHER PUBLICATIONS

Qi et al, P. 3D Guidance Navigation and Human-Robot Shared Control for Motor Graders in Field Operation, Google Scholar, IEEE, 2022 The 8th International Conference on Mechatronics and Robotics Engineering (ICMRE), Feb. 2022, pp. 79-83. (Year: 2022 ).*

(Continued)

*Primary Examiner* — Russell Frejd
(74) *Attorney, Agent, or Firm* — Wilson Sonsini Goodrich & Rosati

(57) ABSTRACT

Systems and methods of bulldozer planning and control are disclosed.

18 Claims, 9 Drawing Sheets

(56) References Cited

U.S. PATENT DOCUMENTS

| | | | | |
|---|---|---|---|---|
| 2021/0095438 | A1 | 4/2021 | Cámara Puerto et al. | |
| 2022/0195693 | A1 | 6/2022 | Kalantar et al. | |
| 2022/0267999 | A1 | 8/2022 | Hartvig Andersen | |
| 2023/0194280 | A1* | 6/2023 | Braunstein | G01C 21/3461 |
| 2024/0117598 | A1* | 4/2024 | Kotlaba | E02F 9/264 |
| 2025/0084613 | A1 | 3/2025 | Gupta et al. | |

OTHER PUBLICATIONS

Mononen et al, T. Blade Control for Surface Profile Tracking by Heavy-Duty Bulldozers, Google Scholar, Proceedings of the ASME/BATH 2021 Symposium on Fluid Power and Motion Control (FPMC2021), Oct. 2021, pp. 1-8. (Year: 2021).*

PCT/US2024/041056 International Search Report and Written Opinion dated Dec. 30, 2024.

PCT/US2024/041056 Invitation to Pay Additional Fees dated Nov. 16, 2024.

PCT/US2024/045356 International Search Report and Written Opinion dated Nov. 22, 2024.

Ruiz, A. Use of rotation matrices to plot a circle of equal altitude. Journal of Maritime Research 8(3):51-57 (2011).

U.S. Appl. No. 18/464,069 Office Action dated Jun. 30, 2025.

* cited by examiner

BULLDOZER PLANNING AND CONTROL

CROSS REFERENCE

This application claims the benefit of priority to U.S. Application No. 63/518,238, filed Aug. 8, 2023, which is incorporated by reference herein in its entirety.

BACKGROUND

Earth-moving vehicles (EMVs) are heavy equipment machines designed to move large quantities of earth, rocks, soil, or debris during construction, mining, agriculture, or any other construction activity. These vehicles are designed to perform a variety of tasks, such as excavation, grading, leveling, hauling, and demolition. A bulldozer can be used to move and grade dirt across large tracts of land. Grading in construction includes the work of forming a surface that is level or has a specified slope for a construction work to build foundations, roads, railway, landscapes, or drainage.

SUMMARY

In one aspect, disclosed herein is a computer-implemented method of controlling an earth-moving vehicle (EMV) including a blade, the method comprising: directing, by a computer, the EMV in a target region having a portion of soil to remove, wherein the blade is not touching the ground; detecting, by the computer, one or more changes in a terrain of the target region; generating, by the computer, a terrain map based at least in part on the one or more changes in the terrain; determining, by the computer, a path for the EMV to traverse based at least in part on the terrain map; and dynamically adjusting, by the computer, a depth of the blade as the EMV traverses the path to obtain a target volume of soil.

In some embodiments, the terrain map includes a plurality of features comprising one or more elevations, angles, slopes, distances, and/or soils. In some embodiments, detecting one or more changes comprises using a sensor to detect the plurality of features. In some embodiments, the sensors comprises a light detection and ranging (LIDAR) detector mounted on the EMV. In some embodiments, the sensor uses kinematics modeling to detect one or more blind spots of the LIDAR detector. In some embodiments, the kinematics modeling comprises one or more computations of angle, speed, terrain perception, and blade position. In some embodiments, the sensor includes an inertial measurement unit (IMU). In some embodiments, the terrain map is 3-dimensional (3D). In some embodiments, generating the terrain map comprises generating a piecewise linear function of the target region. In some embodiments, the piecewise linear function includes a 2-dimensional (2D) representation of the target region, and wherein the 2D representation corresponds to an x-direction and a z-direction of the terrain. In some embodiments, the x-direction represents a lateral movement from a cut start point to a cut end point, and wherein the z-direction represents a vertical movement from the cut start point to the cut end point. In some embodiments, the piecewise linear function includes one or more angles between a plurality of slopes of the terrain. In some embodiments, generating the terrain map comprises approximating one or more features of the terrain. In some embodiments, the piecewise linear function comprises a plurality of linear pieces that are connected to one another, and wherein approximating the one or more features comprises setting a length of the pieces to a predetermined length. In some embodiments, the method further comprises, before dynamically adjusting the depth, calculating, by the computer, a target depth based at least in part on the target volume of soil. In some embodiments, the target volume is equal to a product of the target depth, a width of the blade, and a target distance of cutting. In some embodiments, the target distance includes a cut distance, a cut start point, and a cut end point for the EMV. In some embodiments, moving the EMV comprises moving the EMV from the cut start point and the cut end point for a dry run. In some embodiments, moving the EMV comprises moving the EMV from the cut end point to the cut start point after the dry run. In some embodiments, determining the path comprises determining the target depth of the blade at each point between the cut start point and the cut end point. In some embodiments, moving the EMV comprises moving the EMV along one or more elevations and/or one or more slopes of the target region. In some embodiments, the EMV includes a bulldozer. In some embodiments, the method further comprises, determining, by the computer, that a volume of soil in the blade is at capacity before the EMV has traversed the path; directing, by the computer, the EMV to raise its blade above the ground at break point; and directing, by the computer, the EMV away from the path to remove the soil from the blade. In some embodiments, the method further comprises, directing, by the computer, the EMV back to move to the break point after removing the soil from the blade; determining, by the computer, a remainder of the path for the EMV to traverse to remove the soil; and directing, by the computer, the EMV to resume dynamic adjustment of the depth of the blade until a cut point is reached.

Another aspect provided herein is a computer-implemented method of controlling an earth-moving vehicle (EMV) comprising a blade through a target region, the method comprising: recording, by a computer, a terrain map of the target region while the EMV traverses at least a portion of the target region; generating, by the computer, a piecewise linear model of a contour of the target region based on the terrain map of the target region; and generating, by the computer, a cutting path comprising a cut start location, a cut end location, and a cut depth, based on the piecewise linear model and a dimension of the blade.

In some embodiments, recording the terrain map of the target region comprises recording a kinematic motion of the EMV, recording a topographical scan captured by one or more sensors coupled to the EMV, or both. In some embodiments, the sensor comprises a laser sensor, a LIDAR detector, a sonar sensor, a radar, an ultrasonic sensor, or any combination thereof. In some embodiments, the EMV comprises a tractor, a crane, or a bulldozer. In some embodiments, the EMV is autonomous or semi-autonomous. In some embodiments, the EMV is driverless. In some embodiments, the method further comprises directing, by the computer, the EMV to traverse the portion of the target region. In some embodiments, the dimension of the blade comprises a blade width, a blade depth, a blade height, a blade volume, or any combination thereof. In some embodiments, the method further comprises directing, by the computer, the EMV to traverse the cutting path at the generated cut depth. In some embodiments, the method further comprises measuring, by the computer, a weight of soil cut by the blade of the EMV, a volume of soil cut by the blade of the EMV, or both. In some embodiments, the method further comprises terminating the cutting path once a predetermined weight of soil, a predetermined volume of soil, or both is cut by the blade of the EMV. In some embodiments, the method further comprises regenerating, by the computer, the cutting path based on the terminated cutting path.

Another aspect provided herein is a computer-implemented system comprising: a digital processing device comprising: at least one processor, an operating system configured to perform executable instructions, a memory, and a computer program including instructions executable by the digital processing device to create an application for controlling an earth-moving vehicle (EMV) including a blade, the application comprising: a module directing the EMV in a target region having a portion of soil to remove, wherein the blade is not touching the ground; a module detecting one or more changes in a terrain of the target region; a module generating a terrain map based at least in part on the one or more changes in the terrain; a module determining a path for the EMV to traverse based at least in part on the terrain map; and a module dynamically adjusting a depth of the blade as the EMV traverses the path to obtain a target volume of soil.

In some embodiments, the terrain map includes a plurality of features comprising one or more elevations, angles, slopes, distances, and/or soils. In some embodiments, detecting one or more changes comprises using a sensor to detect the plurality of features. In some embodiments, the sensor comprises a light detection and ranging (LIDAR) detector mounted on the EMV. In some embodiments, the sensor uses kinematics modeling to detect one or more blind spots of the LIDAR detector. In some embodiments, the kinematics modeling comprises one or more of computations of angle, speed, terrain perception, and blade position. In some embodiments, the sensor includes an IMU. In some embodiments, the terrain map is 3-dimensional (3D). In some embodiments, generating the terrain map comprises generating a piecewise linear function of the target region. In some embodiments, the piecewise linear function includes a 2-dimensional (2D) representation of the target region, and wherein the 2D representation corresponds to an x-direction and a z-direction of the terrain. In some embodiments, the x-direction represents a lateral movement from a cut start point to a cut end point, and wherein the z-direction represents a vertical movement from the cut start point to the cut end point. In some embodiments, the piecewise linear function includes one or more angles between a plurality of slopes of the terrain. In some embodiments, generating the terrain map comprises approximating one or more features of the terrain. In some embodiments, the piecewise linear function comprises a plurality of linear pieces that are connected to one another, and wherein approximating the one or more features comprises setting a length of the pieces to a predetermined length. In some embodiments, application further comprises a module calculating a target depth based at least in part on the target volume of soil. In some embodiments, the target volume is equal to a product of the target depth, a width of the blade, and a target distance of cutting. In some embodiments, the target distance includes a cut distance, a cut start point, and a cut end point for the EMV. In some embodiments, moving the EMV comprises moving the EMV from the cut start point and the cut end point for a dry run. In some embodiments, moving the EMV comprises moving the EMV from the cut end point to the cut start point after the dry run. In some embodiments, determining the path comprises determining the target depth of the blade at each point between the cut start point and the cut end point. In some embodiments, moving the EMV comprises moving the EMV along one or more elevations and/or one or more slopes of the target region. In some embodiments, the EMV includes a bulldozer. In some embodiments, the application further comprises: a module determining that a volume of soil in the blade is at capacity before the EMV has traversed the path; a module directing the EMV to raise its blade above the ground at break point; and a module directing the EMV away from the path to remove the soil from the blade. In some embodiments, the application further comprises a module directing the EMV back to move to the break point after removing the soil from the blade; a module determining a remainder of the path for the EMV to traverse to remove the soil; and a module directing the EMV to resume dynamic adjustment of the depth of the blade until a cut point is reached.

Another aspect provided herein is a computer-implemented system comprising: a digital processing device comprising: at least one processor, an operating system configured to perform executable instructions, a memory, and a computer program including instructions executable by the digital processing device to create an application for controlling an earth-moving vehicle (EMV) comprising a blade through a target region comprising, the application comprising: a module recording a terrain map of the target region while the EMV traverses at least a portion of the target region; a module generating a piecewise linear model of a contour of the target region based on the terrain map of the target region; and a module generating a cutting path comprising a cut start location, a cut end location, and a cut depth, based on the piecewise linear model and a dimension of the blade. In some embodiments, recording the terrain map of the target region comprises recording a kinematic motion of the EMV, recording a topographical scan captured by one or more sensors coupled to the EMV, or both. In some embodiments, the sensor comprises a laser sensor, a LIDAR detector, a sonar sensor, a radar, an ultrasonic sensor, or any combination thereof. In some embodiments, the EMV comprises a tractor, a crane, or a bulldozer. In some embodiments, the EMV is autonomous or semi-autonomous. In some embodiments, the EMV is driverless. In some embodiments, the application further comprises a module directing the EMV to traverse the portion of the target region. In some embodiments, the dimension of the blade comprises a blade width, a blade depth, a blade height, a blade volume, or any combination thereof. In some embodiments, the application further comprises a module directing the EMV to traverse the cutting path at the generated cut depth. In some embodiments, the application further comprises a module measuring a weight of soil cut by the blade of the EMV, a volume of soil cut by the blade of the EMV, or both. In some embodiments, the application further comprises a module terminating the cutting path once a predetermined weight of soil, a predetermined volume of soil, or both is cut by the blade of the EMV. In some embodiments, the application further comprises a module regenerating the cutting path based on the terminated cutting path.

Another aspect provided herein is a non-transitory computer-readable storage media encoded with a computer program including instructions executable by a processor to create an application for controlling an earth-moving vehicle (EMV) including a blade, the application comprising: a module directing the EMV in a target region having a portion of soil to remove, wherein the blade is not touching the ground; a module detecting one or more changes in a terrain of the target region; a module generating a terrain map based at least in part on the one or more changes in the terrain; a module determining a path for the EMV to traverse based at least in part on the terrain map; and a module dynamically adjusting a depth of the blade as the EMV traverses the path to obtain a target volume of soil.

In some embodiments, the terrain map includes a plurality of features comprising one or more elevations, angles, slopes, distances, and/or soils. In some embodiments, detecting one or more changes comprises using a sensor to detect the plurality of features. In some embodiments, the sensor comprises a light detection and ranging (LIDAR) detector mounted on the EMV. In some embodiments, the sensor uses kinematics modeling to detect one or more blind spots of the LIDAR detector. In some embodiments, the kinematics modeling comprises one or more of computations of angle, speed, terrain perception, and blade position. In some embodiments, the sensor includes an IMU. In some embodiments, the terrain map is 3-dimensional (3D). In some embodiments, generating the terrain map comprises generating a piecewise linear function of the target region. In some embodiments, the piecewise linear function includes a 2-dimensional (2D) representation of the target region, and wherein the 2D representation corresponds to an x-direction and a z-direction of the terrain. In some embodiments, the x-direction represents a lateral movement from a cut start point to a cut end point, and wherein the z-direction represents a vertical movement from the cut start point to the cut end point. In some embodiments, the piecewise linear function includes one or more angles between a plurality of slopes of the terrain. In some embodiments, generating the terrain map comprises approximating one or more features of the terrain. In some embodiments, the piecewise linear function comprises a plurality of linear pieces that are connected to one another, and wherein approximating the one or more features comprises setting a length of the pieces to a predetermined length. In some embodiments, the application further comprises a module calculating, by the computer, a target depth based at least in part on the target volume of soil before dynamically adjusting the depth. In some embodiments, the target volume is equal to a product of the target depth, a width of the blade, and a target distance of cutting. In some embodiments, the target distance includes a cut distance, a cut start point, and a cut end point for the EMV. In some embodiments, moving the EMV comprises moving the EMV from the cut start point and the cut end point for a dry run. In some embodiments, moving the EMV comprises moving the EMV from the cut end point to the cut start point after the dry run. In some embodiments, determining the path comprises determining the target depth of the blade at each point between the cut start point and the cut end point. In some embodiments, moving the EMV comprises moving the EMV along one or more elevations and/or one or more slopes of the target region. In some embodiments, the EMV includes a bulldozer. In some embodiments, the application further comprises a module determining that a volume of soil in the blade is at capacity before the EMV has traversed the path; a module directing the EMV to raise its blade above the ground at break point; and a module directing the EMV away from the path to remove the soil from the blade. In some embodiments, the application further comprises a module directing the EMV back to move to the break point after removing the soil from the blade; a module determining a remainder of the path for the EMV to traverse to remove the soil; and a module directing the EMV to resume dynamic adjustment of the depth of the blade until a cut point is reached.

Another aspect provided herein is a non-transitory computer-readable storage media encoded with a computer program including instructions executable by a processor to create an application for controlling an earth-moving vehicle (EMV) comprising a blade through a target region, the application comprising: a module recording a terrain map of the target region while the EMV traverses at least a portion of the target region; a module generating a piecewise linear model of a contour of the target region based on the terrain map of the target region; and a module generating a cutting path comprising a cut start location, a cut end location, and a cut depth, based on the piecewise linear model and a dimension of the blade.

In some embodiments, recording the terrain map of the target region comprises recording a kinematic motion of the EMV, recording a topographical scan captured by one or more sensors coupled to the EMV, or both. In some embodiments, the sensor comprises a laser sensor, a LIDAR detector, a sonar sensor, a radar, an ultrasonic sensor, or any combination thereof. In some embodiments, the EMV comprises a tractor, a crane, or a bulldozer. In some embodiments, the EMV is autonomous or semi-autonomous. In some embodiments, the EMV is driverless. In some embodiments, the application further comprises a module directing the EMV to traverse the portion of the target region. In some embodiments, the dimension of the blade comprises a blade width, a blade depth, a blade height, a blade volume, or any combination thereof. In some embodiments, the application further comprises a module directing the EMV to traverse the cutting path at the generated cut depth. In some embodiments, the application further comprises a module measuring a weight of soil cut by the blade of the EMV, a volume of soil cut by the blade of the EMV, or both. In some embodiments, the application further comprises a module terminating the cutting path once a predetermined weight of soil, a predetermined volume of soil, or both is cut by the blade of the EMV. In some embodiments, the application further comprises a module regenerating the cutting path based on the terminated cutting path.

BRIEF DESCRIPTION OF THE DRAWINGS

The novel features of the disclosure are set forth with particularity in the appended claims. A better understanding of the features and advantages of the present disclosure will be obtained by reference to the following detailed description that sets forth illustrative embodiments, in which the principles of the disclosure are utilized, and the accompanying drawings of which:

DETAILED DESCRIPTION

Grading is the process of reshaping land at a construction site. This can include raising or lowering ground levels, adding or removing slopes, or leveling the ground surface. In general, grading is performed to create proper drainage and/or to prepare land to bear the weight of buildings, roads, and other structures. Grading varies depending on each project's scale and needs. Proper grading prevents pooling of water and other liquids that can damage grass, attract mosquitos, and cause structural damage. Proper grading can also prevent future construction issues because laying a foundation on unlevel ground, for example, can become costly to repair.

Grading can be challenging for various reasons. First, grading by a human operator to estimate grading depths can cause safety issues when heavy machinery (e.g., bulldozers) are in the area. Also, effective and efficient grading accounts for soil type, drainage angles, swells, and/or groundwater levels which can be challenging to do manually.

While grading is currently performed by a human operator controlling the motion of a bulldozer and the relative position of its blade, human error and lack of accuracy may lead to repetition and inefficiencies. Autonomous grading options enable reduce the danger of working conditions and increase productivity and speed. Such automation requires the ability to precisely operate both the earth-moving vehicle (EMV) as well as its attachments and tools.

As such, provided herein are methods, systems, and media for autonomous operation of EMVs and their components. The terrain mapping and contour recording of the methods, systems, and media herein enables precise and accurate soil removal and grading by an autonomous EMV.

Methods, Systems, and Media for Controlling an EMV

In one aspect, disclosed herein is a computer-implemented method of controlling an earth-moving vehicle (EMV) including a blade. Also provided herein is a computer-implemented system comprising: a digital processing device comprising at least one processor, an operating system configured to perform executable instructions, a memory, and a computer program including instructions executable by the digital processing device to create an application for controlling an earth-moving vehicle (EMV). Further, provided herein is a non-transitory computer-readable storage media encoded with a computer program including instructions executable by a processor to create an application for controlling an earth-moving vehicle (EMV) comprising a blade through a target region.

Figure 1:
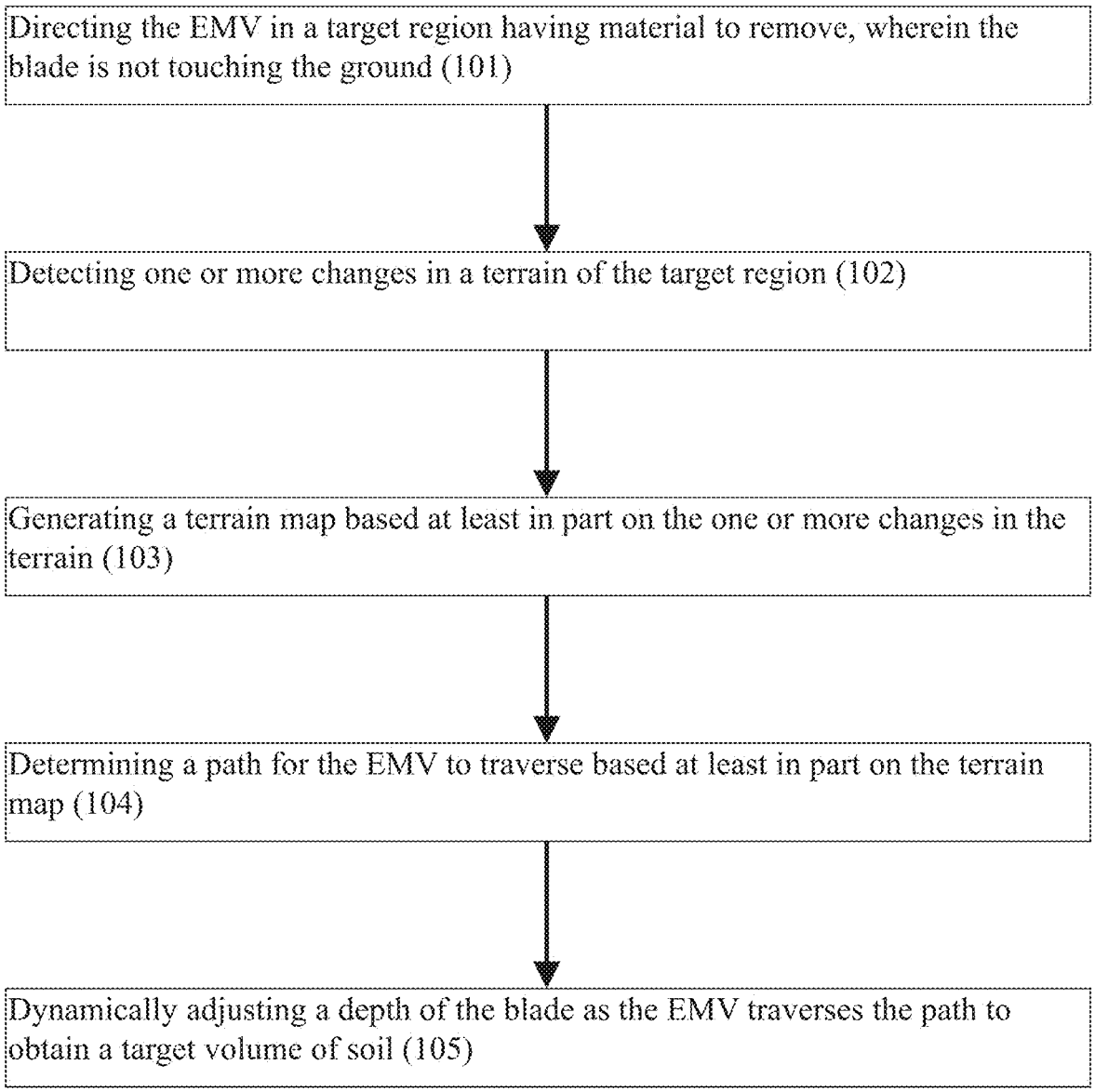
FIG. 1 shows a diagram of a first exemplary computer-implemented method of controlling an earth-moving vehicle (EMV), per one or more embodiments herein.
Figure 3A:
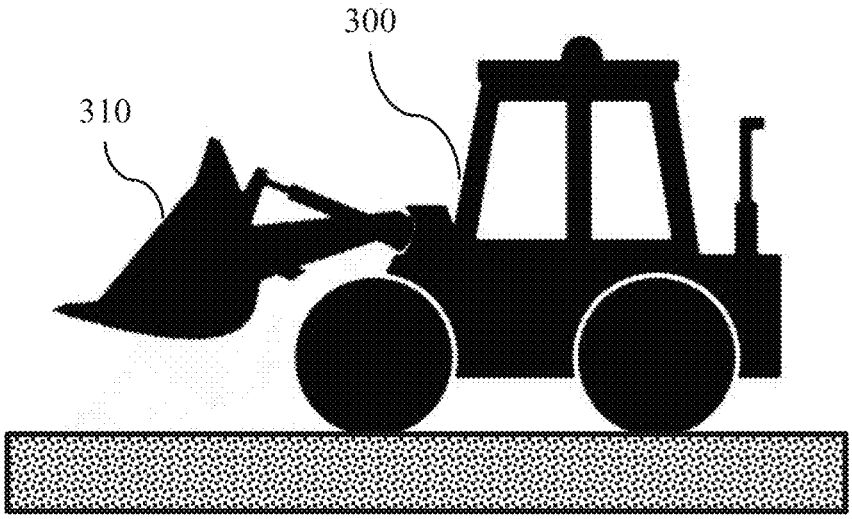
FIG. 3A shows an illustration of an exemplary EMV with its blade in an upward position, per one or more embodiments herein.

In some embodiments, per FIG. 1, the methods and applications herein: direct the EMV in a target region having a portion of soil to remove, wherein the blade is not touching the ground 101, one or more changes in a terrain of the target region 102, FIG. 3A shows an illustration of an exemplary EMV with its blade in an upward position, per one or more embodiments herein;

based at least in part on the one or more changes in the terrain 103, determine a path for the EMV to traverse based at least in part on the terrain map 104, and dynamically adjust a depth of the blade as the EMV traverses the path to obtain a target volume of soil 105.

Figure 2:
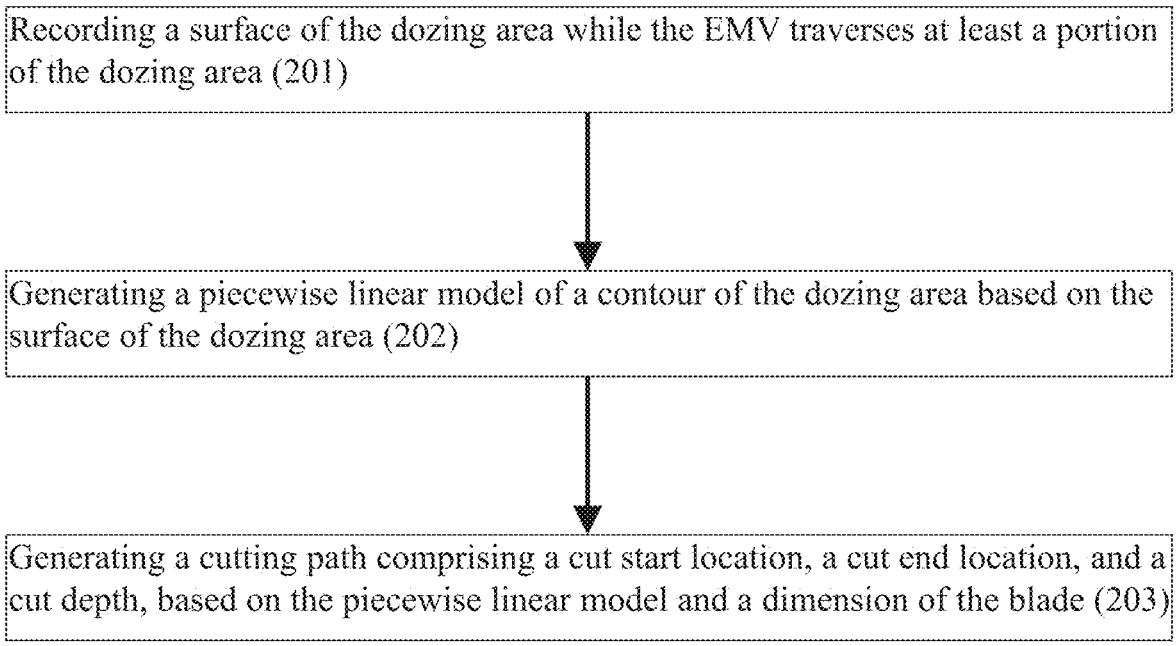
FIG. 2 shows a diagram of a second exemplary computer-implemented method of controlling an EMV, per one or more embodiments herein.

In some embodiments, per FIG. 2, the methods and applications herein record a terrain map of the target region while the EMV traverses at least a portion of the target region 201, generate a piecewise linear model of a contour of the target region based on the terrain map of the target region 202, and generate, by the computer, a cutting path comprising a cut start location, a cut end location, and a cut depth, based on the piecewise linear model and a dimension of the blade 203.

In some embodiments, the EMV comprises a tractor, a crane, or a bulldozer. In some embodiments, the EMV is autonomous or semi-autonomous. In some embodiments, the EMV is driverless. In one example, per FIGS. 3A-3B, the EMV comprises a bulldozer 300 having a blade 310.

Figure 4:
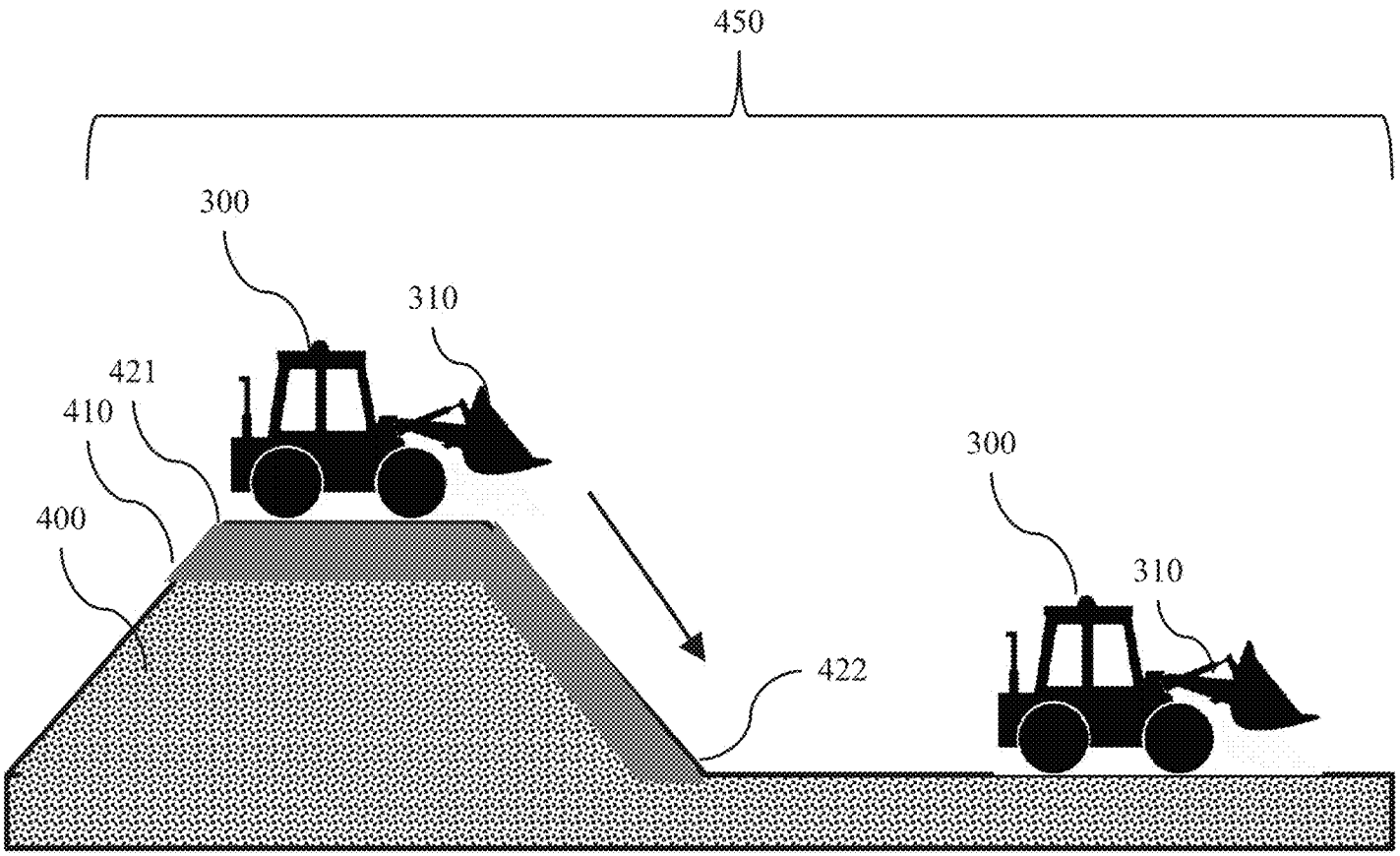
FIG. 4 shows an illustration of an exemplary EMV being directed through a target region to form a terrain map, per one or more embodiments herein.

FIG. 4 shows an illustration of directing the EMV 300 in a target region 450, wherein the blade 310 is not touching the soil 400. In some embodiments, the target region 450 comprises soil 400. In some embodiments, the target region 450 comprises a portion of soil to remove 410. As shown, in some embodiments, the target region 450 comprises one or more sloped portions and one or more flat portions. In some embodiments, depending on the order of operations of a construction project the soil to remove 410 is on the sloped portion or the flat portion.

The width, length, and depth of the blade 310 can at least in part determine a volume of the blade 310 and thus a volume of the soil that can be removed in one scoop of the blade 310.

Target Regions

In some embodiments, the methods and applications herein direct the EMV 300 in a target region 450. In some embodiments, the target region 450 comprises soil 400. In some embodiments, the target region 450 comprises a portion of soil to remove 410.

In some embodiments, the soil comprises topsoil, subsoil, clay, silt, sand, gravel, peat, loam, chalk, rock, or any combination thereof. Topsoil is the uppermost layer of soil, typically the first to be removed during construction. Subsoil is located beneath the topsoil, which is removed during construction to ensure a stable foundation. Clay is heavy, sticky and challenging to work with due to its tendency to expand when wet and shrink when dry. Clay is often removed or treated during construction to prevent instability. Silt is a fine-grained soil that can be easily compacted, may cause drainage issues on a construction site, and is often removed or treated to improve stability. Sand is a coarse-grained soil that drains well but may not provide a stable foundation due to its tendency to shift. Gravel comprises small, rounded stones mixed with sand and clay. Gravel is often removed during construction, particularly if a smooth, flat surface is needed. Peat comprises decomposed plant material that holds a lot of water and is often removed during construction to form a stable foundation. Loam is a mixture of sand, silt, and clay. Chalk, a form of limestone, can be problematic for construction due to its high permeability and potential for instability when wet. Rocks often need to be removed during construction, particularly in hilly or mountainous areas.

In some embodiments, the target region is defined by GPS. In some embodiments, the target region is defined by a visual marker wherein the methods and applications herein further determine the target region based on images captured by one or more sensors coupled to the EMV. In some embodiments, the GPS coordinates form a fence defining the target region. In some embodiments, the methods and applications herein direct the EMV to a soil discarding region outside the target region. In some embodiments, the discarding region is defined by GPS coordinates. In some embodiments, the discarding region is defined by a visual marker wherein the methods and applications herein further determine the target region based on images captured by one or more sensors coupled to the EMV.

In some embodiments, at least a portion of the target region is associated with a target depth of soil to remove, a target height of the portion after soil removal, or both. In some embodiments, the target depth, the target height, or both are received by the EMV as an input, by an indicator on the visual maker, or both. In some embodiments, at least a portion of the target region is associated with a type of soil to remove, wherein the type of soil is received by the EMV as an input, by an indicator on the visual maker, or both. In some embodiments, at least a portion of the target region is associated with a required compression index, wherein the required compression index is received by the EMV as an input, by an indicator on the visual maker, or both. In some embodiments, the methods and applications herein further define a no-go region, where the EMV cannot travel beyond.

Terrain Maps

In some embodiments, the methods and applications herein generate a terrain map. In some embodiments, per FIG. 4, the methods and applications herein record a terrain map of the target region 450 while the EMV 300 traverses at least a portion of the target region. In some embodiments the portion of the target region spans from a mapping start point 421 to a mapping end point 422. In some embodiments, the methods and applications herein direct the EMV 300 in a target region 450 while the blade 310 is not touching the ground, per FIG. 3A.

In some embodiments, the methods and applications herein generate a terrain map based at least in part on the one or more changes in the terrain. In some embodiments, detecting one or more changes comprises using a sensor to detect the plurality of features. In some embodiments, recording the terrain map of the target region comprises recording a kinematic motion of the EMV. In some embodiments, recording the terrain map of the target region comprises recording a topographical scan of the target region. In some embodiments, recording the terrain map of the target region comprises recording a kinematic motion of the EMV and recording a topographical scan of the target region. In some embodiments, using both the recorded kinematic motion of the EMV and the topographical scan of the target region enables complete capture of the terrain of the target region.

In some embodiments, the terrain map is three-dimensional (3D). In some embodiments, the terrain map employs three Cartesian perpendicular dimensions, spherical dimensions, polar dimensions, or any combination thereof. In some embodiments, the changes in the terrain, the topographical scan, the kinematic motion of the EMV, or any combination thereof are continually captured, such that the terrain map represents a surface of the target region in real-time or near-real time. In some embodiments, the terrain map further comprises a location of another mobile EMV, a determined location of a human worker, a location of an installed structure, or any combination thereof.

In some embodiments, the kinematic motion of the EMV, the topographical scan, or both, are recorded by one or more sensors. In some embodiments, the sensor is coupled to the EMV. In some embodiments, the sensor is removably coupled to the EMV. In some embodiments, the sensor comprises a laser sensor, a LIDAR detector, a sonar sensor, a radar, an ultrasonic sensor, an inertial measurement unit (IMU), a tilt sensor, a gyroscope, a magnetometer, an accelerometer, a global positioning system (GPS) sensor, a camera, or any combination thereof. In some embodiments, the laser sensor, also known as a laser telemeter or laser rangefinder, uses a laser beam to determine the distance to an object. The most common form of laser sensors operates on the time-of-flight principle by sending a laser pulse in a narrow beam towards the object and measuring the time taken by the pulse to be reflected off the target and returned to the sender. LIDAR is an acronym of "Light Detection and Ranging" or "Laser Imaging, Detection, and Ranging." LIDAR determines ranges by targeting an object or a surface with a laser and measuring the time for the reflected light to return to the receiver. Sonar sensors use sound propagation to measure distances. Inclinometers and tilt sensors, also known as a tilt indicator, tilt meter, slope alert, slope gauge, gradient meter, gradiometer, level gauge, level meter, declinometer, and pitch & roll indicator, measures angles of slope, elevation, or depression of an object with respect to gravity's direction in units of degrees, percentage points, or topos. Similarly a gyroscope uses a rotating wheel mounted into two or three gimbals to measure the pitch, roll and yaw orientation of an object. A magnetometer measures magnetic field or magnetic dipole moment. Different types of magnetometers measure the direction, strength, or relative change of a magnetic field at a particular location. A compass is one such device, one that measures the direction of an ambient magnetic field. An accelerometer measures the acceleration (the rate of change of velocity) of a body in its own instantaneous rest frame. Topographies can be determined by relative measurement between two or more points via an algorithm or image recognition process. Data obtained by the one or more of the aforementioned sensors may be combined to generate a terrain map of the area surrounding the EMV 300.

Figure 5:
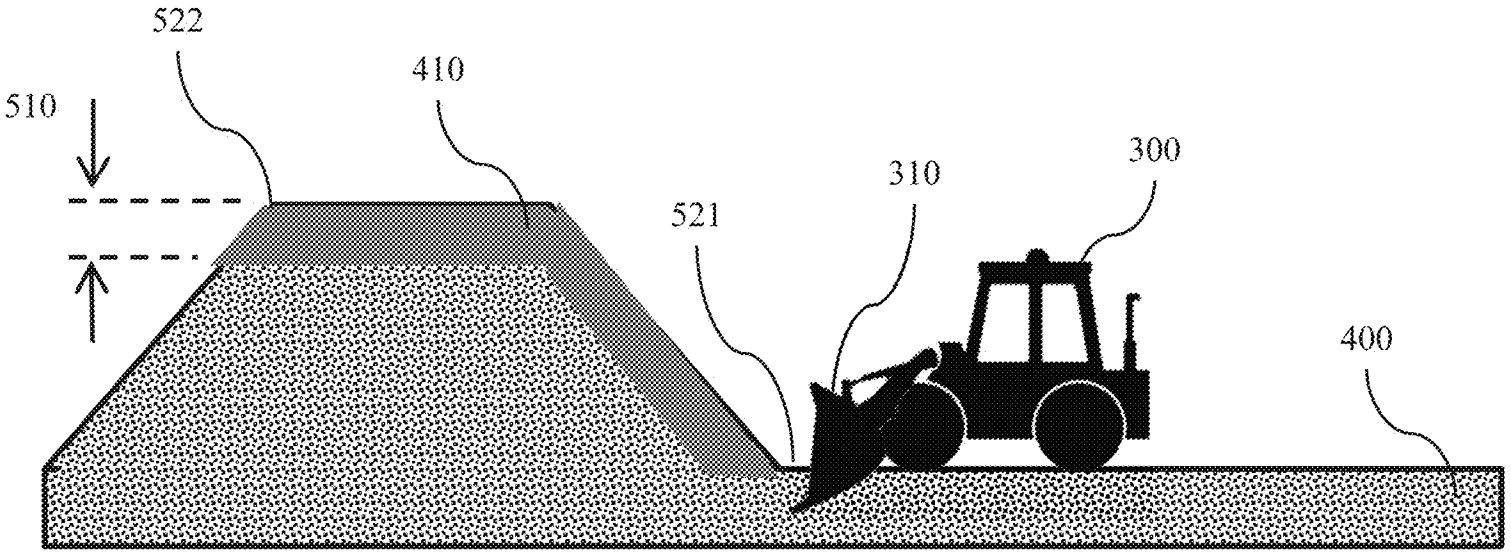
FIG. 5 shows an illustration of an exemplary EMV removing a portion of soil from a target region, per one or more embodiments herein.
Figure 6:
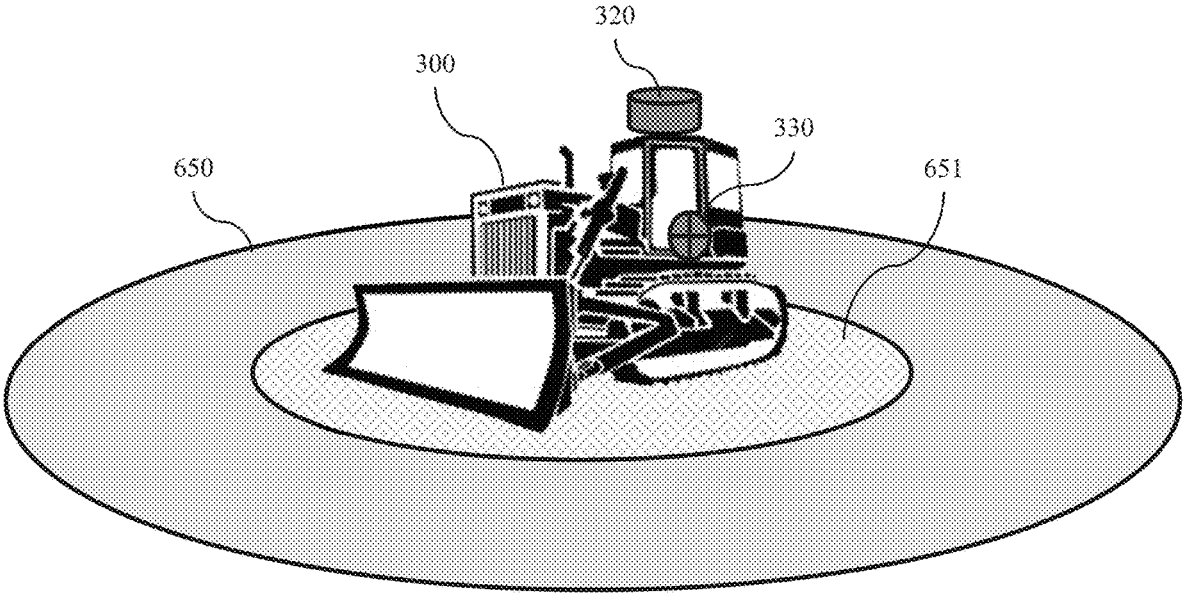
FIG. 6 shows an illustration of an exemplary EMV forming a terrain map, per one or more embodiments herein.

In one example, per FIG. 6, the EMV 300 comprises a first sensor 320 recording a kinematic motion of the EMV 300 and a second sensor 330 recording a topographical scan of the target region 650. In this example, the first sensor 320 may be an accelerometer and the second sensor 330 is a LIDAR detector. As shown, the use of both the first sensor 320 and the second sensor 330 enables a terrain map to be recorded of the entire target region 650, including obscured area 651 of the target region blocked from view from the EMV 300. In some embodiments, the use of both the first sensor 320 and the second sensor 330 enables accurate and detailed terrain map measurement, especially at slope inflection points, such as that shown in FIG. 5.

In some embodiments, the methods and applications herein generate a piecewise linear model of a contour of the target region based on the terrain map of the target region. In some embodiments, generating the terrain map comprises generating a piecewise linear function of the target region. In some embodiments, the terrain map includes a plurality of features comprising one or more elevations, angles, slopes, distances, and/or soils. In some embodiments, the kinematics modeling comprises one or more computations of angle, speed, terrain perception, and blade position.

In some embodiments, the piecewise linear function includes a 2-dimensional (2D) representation of the target region. In some embodiments, the 2D representation corresponds to an x-direction and a z-direction of the terrain. In some embodiments, the x-direction represents a lateral movement from a cut start point to a cut end point. In some embodiments, the z-direction represents a vertical movement from the cut start point to the cut end point. In some embodiments, the piecewise linear function includes one or more angles between a plurality of slopes of the terrain. In some embodiments, the piecewise linear function comprises a plurality of linear pieces that are connected to one another, and wherein approximating the one or more features comprises setting a length of the pieces to a predetermined length. In some embodiments, generating the terrain map comprises approximating one or more features of the terrain.

Cutting Paths

In some embodiments, the methods and applications herein determine a path for the EMV to traverse. In some embodiments, the methods and applications herein determine a path for the EMV to traverse based at least in part on the terrain map. In some embodiments, the methods and applications herein generate a cutting path comprising a cut start location, a cut end location, and a cut depth, based on the piecewise linear model and a dimension of the blade.

In some embodiments, per FIG. 5, the cutting path comprises a path from a cut start point 521 to a cut end point 522. In some embodiments, moving the EMV 300 comprises moving the EMV 300 from the cut start point 521 to the cut end point 522. In some embodiments, moving the EMV 300 comprises moving the EMV 300 from the cut start point 521 to the cut end point 522 after the terrain map is generated. In some embodiments, moving the EMV 300 comprises moving the EMV 300 from the cut start point 521 to the cut end point 522 for a dry run.

In some embodiments, cut start point 521 is the mapping end point 422. In some embodiments, cut end point 522 is the mapping stop point 421. In some embodiments, cut start point 521 is the mapping start point 421. In some embodiments, cut end point 522 is the mapping start point 421. In some embodiments, a distance between the mapping start point 421 and the mapping end point 422 is equal to or greater than a distance from the cut start point 521 to the cut end point 522. In some embodiments, a distance between the mapping start point 421 and the mapping end point 422 is equal to or greater than a distance from the cut start point 521 to the cut end point 522.

Figure 3B:
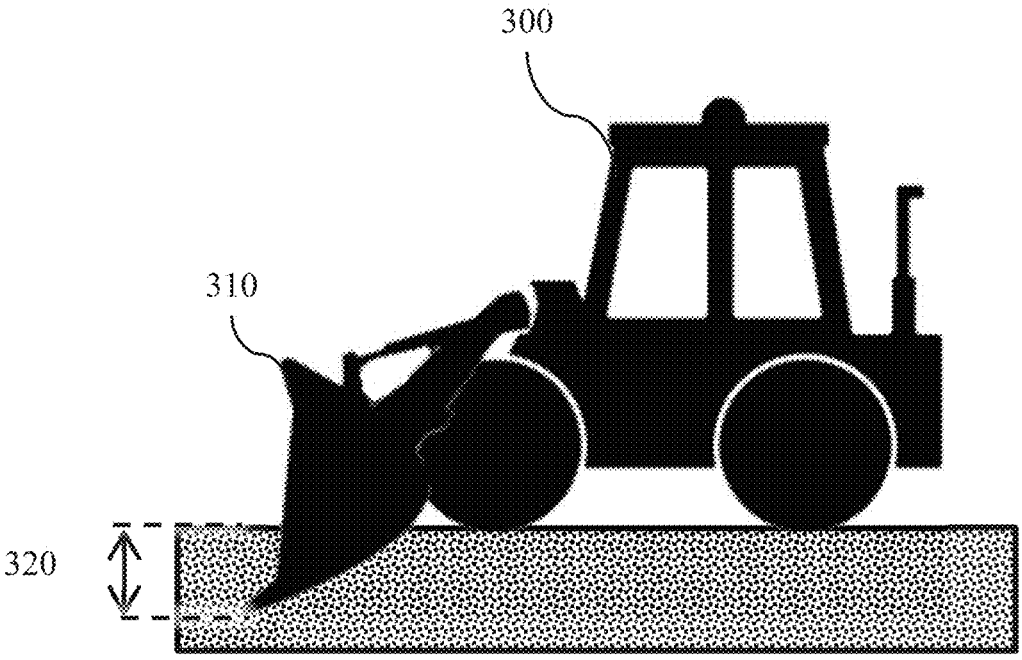
FIG. 3B shows an illustration of an exemplary EMV with its blade in digging position, per one or more embodiments herein.

In some embodiments, per FIGS. 3B and 5, the methods and applications herein dynamically adjust a cutting depth 320 of the blade 310 as the EMV 300 traverses the path. In some embodiments, the methods and applications herein dynamically adjust a cutting depth 320 of the blade 310 as the EMV 300 traverses the path to obtain a target volume of soil 410. In some embodiments, the methods and applications herein dynamically adjust a cutting depth 320 of the blade 310 as the EMV 300 traverses the path based on a slope of the soil 400. In some embodiments, the blade 310 is coupled to the EMV 300 by a load sensor, wherein the methods and applications herein dynamically adjust a cutting depth 320 of the blade 310 as the EMV 300 traverses the path based on a weight of the soil 400 as measured by the load sensor. In some embodiments, the EMV 300 comprises a sensor providing a live video of the soil 400 in the blade 310, wherein the methods and applications herein dynamically adjust a cutting depth 320 of the blade 310 as the EMV 300 traverses the path based on a weight of the soil 400 based on a weight of the soil 400 as calculated by a machine learning algorithm processing the live video. The methods and applications herein dynamically adjust a cutting depth 320 of the blade 310 as the EMV 300 traverses the path based on a received estimated soil density. In some embodiments, the sensor comprises a laser sensor, a LIDAR detector, a sonar sensor, a radar, an ultrasonic sensor, or any combination thereof.

In the example shown in FIG. 5, the methods and applications herein adjust the blade 310 to a first cutting depth as the EMV 300 begins its cut from an upward slope of the soil 400, and gradually adjusts the blade 310 to a second cutting depth as the EMV 300 mounts the ridge and reaches a negligible slope, wherein the first cutting depth is greater than the second cutting depth. In some embodiments, the method further comprises, before dynamically adjusting the cutting depth, calculating a target depth 510 based at least in part on the target volume of soil to be removed 410.

In some embodiments, the target volume is equal to a product of the target depth, a width of the blade, and a target distance of cutting. In some embodiments, the target distance includes a cut distance, a cut start point 521, and a cut end point 522 for the EMV. In some embodiments, determining the path comprises determining the target depth of the blade at each point between the cut start point and the cut end point. In some embodiments, moving the EMV comprises moving the EMV along one or more elevations and/or one or more slopes of the target region.

In some embodiments, the method further comprises, determining that a volume of soil in the blade is at capacity before the EMV has traversed the path; directing the EMV to raise its blade above the ground at a break point where the blade pierces the soil; and directing the EMV away from the path to remove the soil from the blade. In some embodiments, the method further comprises, directing the EMV back to move to the break point after removing the soil from the blade; determining a remainder of the path for the EMV to traverse to remove the soil; and directing the EMV to resume dynamic adjustment of the depth of the blade until a cut point is reached.

In some embodiments, the method further comprises directing the EMV to traverse the portion of the target region. In some embodiments, the dimension of the blade comprises a blade width, a blade depth, a blade height, a blade volume, or any combination thereof. In some embodiments, the method further comprises directing the EMV to traverse the cutting path at the generated cut depth. In some embodiments, the method further comprises measuring a weight of soil cut by the blade of the EMV, a volume of soil cut by the blade of the EMV, or both. In some embodiments, the method further comprises terminating the cutting path once a predetermined weight of soil, a predetermined volume of soil, or both is cut by the blade of the EMV. In some embodiments, the method further comprises regenerating the cutting path based on the terminated cutting path. In some embodiments, the method further comprises directing the EMV to a dump site to dispose of the removed soil. In some embodiments, the cutting path further comprises a dump site to dispose of the removed soil.

Terms and Definitions

Unless otherwise defined, all technical terms used herein have the same meaning as commonly understood by one of ordinary skill in the art to which this disclosure belongs.

As used herein, the singular forms "a," "an," and "the" include plural references unless the context clearly dictates otherwise. Any reference to "or" herein is intended to encompass "and/or" unless otherwise stated.

As used herein, the term "about" in some cases refers to an amount that is approximately the stated amount.

As used herein, the term "about" refers to an amount that is near the stated amount by 10%, 5%, or 1%, including increments therein.

As used herein, the term "about" in reference to a percentage refers to an amount that is greater or less the stated percentage by 10%, 5%, or 1%, including increments therein.

As used herein, the phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Computing System

Figure 7:
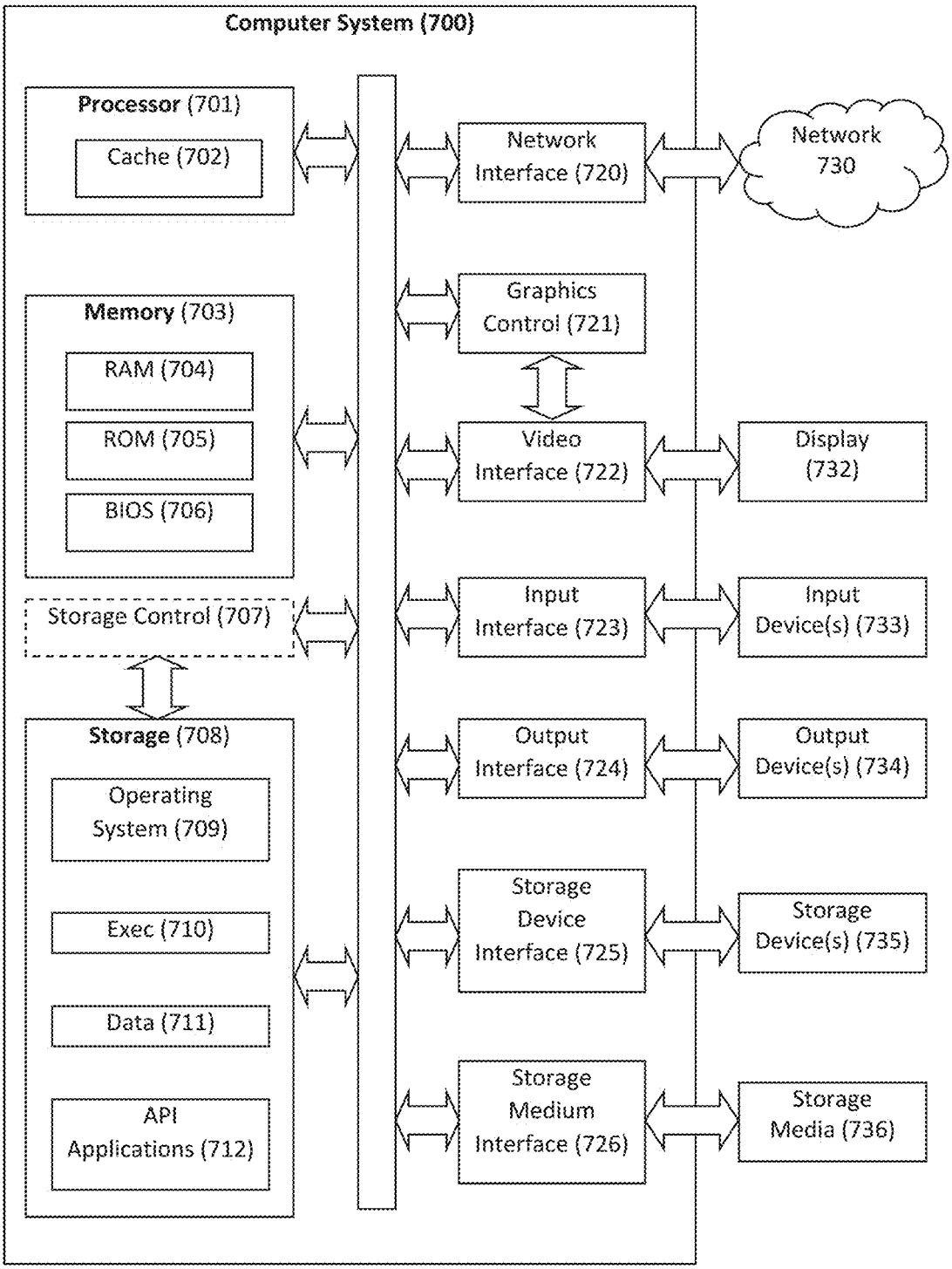
FIG. 7 shows a non-limiting example of a computing device; in this case, a device with one or more processors, memory, storage, and a network interface.

Referring to FIG. 7, a block diagram is shown depicting an exemplary machine that includes a computer system 700 (e.g., a processing or computing system) within which a set of instructions can execute for causing a device to perform or execute any one or more of the aspects and/or methodologies for static code scheduling of the present disclosure. The components in FIG. 7 are examples only and do not limit the scope of use or functionality of any hardware, software, embedded logic component, or a combination of two or more such components implementing particular embodiments.

Computer system 700 may include one or more processors 701, a memory 703, and a storage 708 that communicate with each other, and with other components, via a bus 740. The bus 740 may also link a display 732, one or more input devices 733 (which may, for example, include a keypad, a keyboard, a mouse, a stylus, etc.), one or more output devices 734, one or more storage devices 735, and various tangible storage media 736. All of these elements may interface directly or via one or more interfaces or adaptors to the bus 740. For instance, the various tangible storage media 736 can interface with the bus 740 via storage medium interface 726. Computer system 700 may have any suitable physical form, including but not limited to one or more integrated circuits (ICs), printed circuit boards (PCBs), mobile handheld devices (such as mobile telephones or PDAs), laptop or notebook computers, distributed computer systems, computing grids, or servers.

Computer system 700 includes one or more processor(s) 701 (e.g., central processing units (CPUs) or general-purpose graphics processing units (GPGPUs)) that carry out functions. Processor(s) 701 optionally contains a cache memory unit 702 for temporary local storage of instructions, data, or computer addresses. Processor(s) 701 are configured to assist in execution of computer readable instructions. Computer system 700 may provide functionality for the components depicted in FIG. 7 as a result of the processor(s) 701 executing non-transitory, processor-executable instructions embodied in one or more tangible computer-readable storage media, such as memory 703, storage 708, storage devices 735, and/or storage medium 736. The computer-readable media may store software that implements particular embodiments, and processor(s) 701 may execute the software. Memory 703 may read the software from one or more other computer-readable media (such as mass storage device(s) 735, 736) or from one or more other sources through a suitable interface, such as network interface 720. The software may cause processor(s) 701 to carry out one or more processes or one or more steps of one or more processes described or illustrated herein. Carrying out such processes or steps may include defining data structures stored in memory 703 and modifying the data structures as directed by the software.

The memory 703 may include various components (e.g., machine readable media) including, but not limited to, a random-access memory component (e.g., RAM 704) (e.g., static RAM (SRAM), dynamic RAM (DRAM), ferroelectric random-access memory (FRAM), phase-change random access memory (PRAM), etc.), a read-only memory component (e.g., ROM 705), and any combinations thereof. ROM 705 may act to communicate data and instructions unidirectionally to processor(s) 701, and RAM 704 may act to communicate data and instructions bidirectionally with processor(s) 701. ROM 705 and RAM 704 may include any suitable tangible computer-readable media described below. In one example, a basic input/output system 706 (BIOS), including basic routines that help to transfer information between elements within computer system 700, such as during start-up, may be stored in the memory 703.

Fixed storage 708 is connected bidirectionally to processor(s) 701, optionally through storage control unit 707. Fixed storage 708 provides additional data storage capacity and may also include any suitable tangible computer-readable media described herein. Storage 708 may be used to store operating system 709, executable(s) 710, data 711, applications 712 (application programs), and the like. Storage 708 can also include an optical disk drive, a solid-state memory device (e.g., flash-based systems), or a combination of any of the above. Information in storage 708 may, in appropriate cases, be incorporated as virtual memory in memory 703.

In one example, storage device(s) 735 may be removably interfaced with computer system 700 (e.g., via an external port connector (not shown)) via a storage device interface 725. Particularly, storage device(s) 735 and an associated machine-readable medium may provide non-volatile and/or volatile storage of machine-readable instructions, data structures, program modules, and/or other data for the computer system 700. In one example, software may reside, completely or partially, within a machine-readable medium on storage device(s) 735. In another example, software may reside, completely or partially, within processor(s) 701.

Bus 740 connects a wide variety of subsystems. Herein, reference to a bus may encompass one or more digital signal lines serving a common function, where appropriate. Bus 740 may be any of several types of bus structures including, but not limited to, a memory bus, a memory controller, a peripheral bus, a local bus, and any combinations thereof, using any of a variety of bus architectures. As an example and not by way of limitation, such architectures include an Industry Standard Architecture (ISA) bus, an Enhanced ISA (EISA) bus, a Micro Channel Architecture (MCA) bus, a Video Electronics Standards Association local bus (VLB), a Peripheral Component Interconnect (PCI) bus, a PCI-Express (PCI-X) bus, an Accelerated Graphics Port (AGP) bus, HyperTransport (HTX) bus, serial advanced technology attachment (SATA) bus, and any combinations thereof.

Computer system 700 may also include an input device 733. In one example, a user of computer system 700 may enter commands and/or other information into computer system 700 via input device(s) 733. Examples of an input device(s) 733 include, but are not limited to, an alphanumeric input device (e.g., a keyboard), a pointing device (e.g., a mouse or touchpad), a touchpad, a touch screen, a multi-touch screen, a joystick, a stylus, an audio input device (e.g., a microphone, a voice response system, etc.), an optical sensor, a video or still image capture device (e.g., a camera), and any combinations thereof. In some embodiments, the input device is a Kinect, Leap Motion, or the like. Input device(s) 733 may be interfaced to bus 740 via any of a variety of input interfaces 723 (e.g., input interface 723) including, but not limited to, serial, parallel, USB, FIREWIRE, THUNDERBOLT, or any combination of the above.

In particular embodiments, when computer system 700 is connected to network 730, computer system 700 may communicate with other devices, specifically mobile devices and enterprise systems, distributed computing systems, cloud storage systems, cloud computing systems, and the like, connected to network 730. Communications to and from computer system 700 may be sent through network interface 720. For example, network interface 720 may receive incoming communications (such as requests or responses from other devices) in the form of one or more packets (such as Internet Protocol (IP) packets) from network 730, and computer system 700 may store the incoming communications in memory 703 for processing. Computer system 700 may similarly store outgoing communications (such as requests or responses to other devices) in the form of one or more packets in memory 703 and communicated to network 730 from network interface 720. Processor(s) 701 may access these communication packets stored in memory 703 for processing.

Examples of the network interface 720 include, but are not limited to, a network interface card, a modem, and any combination thereof. Examples of a network 730 or network segment 730 include, but are not limited to, a distributed computing system, a cloud computing system, a wide area network (WAN) (e.g., the Internet, an enterprise network), a local area network (LAN) (e.g., a network associated with an office, a building, a campus or other relatively small geographic space), a telephone network, a direct connection between two computing devices, a peer-to-peer network, and any combinations thereof. A network, such as network 730, may employ a wired and/or a wireless mode of communication. In general, any network topology may be used.

Information and data can be displayed through a display 732. Examples of a display 732 include, but are not limited to, a cathode ray tube (CRT), a liquid crystal display (LCD), a thin film transistor liquid crystal display (TFT-LCD), an organic liquid crystal display (OLED) such as a passive-matrix OLED (PMOLED) or active-matrix OLED (AMOLED) display, a plasma display, and any combinations thereof. The display 732 can interface to the processor(s) 701, memory 703, and fixed storage 708, as well as other devices, such as input device(s) 733, via the bus 740. The display 732 is linked to the bus 740 via a video interface 722, and transport of data between the display 732 and the bus 740 can be controlled via the graphics control 721. In some embodiments, the display is a video projector. In some embodiments, the display is a head-mounted display (HMD) such as a VR headset. In further embodiments, suitable VR headsets include, by way of non-limiting examples, HTC Vive, Oculus Rift, Samsung Gear VR, Microsoft HoloLens, Razer OSVR, FOVE VR, Zeiss VR One, Avegant Glyph, Freefly VR headset, and the like. In still further embodiments, the display is a combination of devices such as those disclosed herein.

In addition to a display 732, computer system 700 may include one or more other peripheral output devices 734 including, but not limited to, an audio speaker, a printer, a storage device, and any combinations thereof. Such peripheral output devices may be connected to the bus 740 via an output interface 724. Examples of an output interface 724 include, but are not limited to, a serial port, a parallel connection, a USB port, a FIREWIRE port, a THUNDERBOLT port, and any combinations thereof.

In addition or as an alternative, computer system 700 may provide functionality as a result of logic hardwired or otherwise embodied in a circuit, which may operate in place of or together with software to execute one or more processes or one or more steps of one or more processes described or illustrated herein. Reference to software in this disclosure may encompass logic, and reference to logic may encompass software. Moreover, reference to a computer-readable medium may encompass a circuit (such as an IC) storing software for execution, a circuit embodying logic for execution, or both, where appropriate. The present disclosure encompasses any suitable combination of hardware, software, or both.

Those of skill in the art will appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality.

The various illustrative logical blocks, modules, and circuits described in connection with the embodiments disclosed herein may be implemented or performed with a general-purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by one or more processor(s), or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In accordance with the description herein, suitable computing devices include, by way of non-limiting examples, server computers, desktop computers, laptop computers, notebook computers, sub-notebook computers, netbook computers, netpad computers, set-top computers, media streaming devices, handheld computers, Internet appliances, mobile smartphones, tablet computers, personal digital assistants, and vehicles. Those of skill in the art will also recognize that select televisions, video players, and digital music players with optional computer network connectivity are suitable for use in the system described herein. Suitable tablet computers, in various embodiments, include those with booklet, slate, and convertible configurations, known to those of skill in the art.

In some embodiments, the computing device includes an operating system configured to perform executable instructions. The operating system is, for example, software, including programs and data, which manages the device's hardware and provides services for execution of applications. Those of skill in the art will recognize that suitable server operating systems include, by way of non-limiting examples, FreeBSD, OpenBSD, NetBSD®, Linux, Apple® Mac OS X Server®, Oracle® Solaris®, Windows Server®, and Novell® NetWare®. Those of skill in the art will recognize that suitable personal computer operating systems include, by way of non-limiting examples, Microsoft® Windows®, Apple® Mac OS X®, UNIX®, and UNIX-like operating systems such as GNU/Linux®. In some embodiments, the operating system is provided by cloud computing. Those of skill in the art will also recognize that suitable mobile smartphone operating systems include, by way of non-limiting examples, Nokia® Symbian® OS, Apple® iOS®, Research In Motion® BlackBerry OS®, Google® Android®, Microsoft® Windows Phone® OS, Microsoft® Windows Mobile® OS, Linux®, and Palm® WebOS®.

Non-Transitory Computer Readable Storage Medium

In some embodiments, the platforms, systems, media, and methods disclosed herein include one or more non-transitory computer readable storage media encoded with a program including instructions executable by the operating system of an optionally networked computing device. In further embodiments, a computer readable storage medium is a tangible component of a computing device. In still further embodiments, a computer readable storage medium is optionally removable from a computing device. In some embodiments, a computer readable storage medium includes, by way of non-limiting examples, CD-ROMs, DVDs, flash memory devices, solid state memory, magnetic disk drives, magnetic tape drives, optical disk drives, distributed computing systems including cloud computing systems and services, and the like. In some cases, the program and instructions are permanently, substantially permanently, semi-permanently, or non-transitorily encoded on the media.

Computer Program

In some embodiments, the platforms, systems, media, and methods disclosed herein include at least one computer program, or use of the same. A computer program includes a sequence of instructions, executable by one or more processor(s) of the computing device's CPU, written to perform a specified task. Computer readable instructions may be implemented as program modules, such as functions, objects, Application Programming Interfaces (APIs), computing data structures, and the like, that perform particular tasks or implement particular abstract data types. In light of the disclosure provided herein, those of skill in the art will recognize that a computer program may be written in various versions of various languages.

The functionality of the computer readable instructions may be combined or distributed as desired in various environments. In some embodiments, a computer program comprises one sequence of instructions. In some embodiments, a computer program comprises a plurality of sequences of instructions. In some embodiments, a computer program is provided from one location. In other embodiments, a computer program is provided from a plurality of locations. In various embodiments, a computer program includes one or more software modules. In various embodiments, a computer program includes, in part or in whole, one or more web applications, one or more mobile applications, one or more standalone applications, add-ins, or add-ons, or combinations thereof.

Web Application

In some embodiments, a computer program includes a web application. In light of the disclosure provided herein, those of skill in the art will recognize that a web application, in various embodiments, utilizes one or more software frameworks and one or more database systems. In some embodiments, a web application is created upon a software framework such as Microsoft® .NET or Ruby on Rails (RoR). In some embodiments, a web application utilizes one or more database systems including, by way of non-limiting examples, relational, non-relational, object oriented, associative, and XML database systems. In further embodiments, suitable relational database systems include, by way of non-limiting examples, Microsoft SQL Server, mySQL™, and Oracle®. Those of skill in the art will also recognize that a web application, in various embodiments, is written in one or more versions of one or more languages. A web application may be written in one or more markup languages, presentation definition languages, client-side scripting languages, server-side coding languages, database query languages, or combinations thereof. In some embodiments, a web application is written to some extent in a markup language such as Hypertext Markup Language (HTML), Extensible Hypertext Markup Language (XHTML), or extensible Markup Language (XML). In some embodiments, a web application is written to some extent in a presentation definition language such as Cascading Style Sheets (CSS). In some embodiments, a web application is written to some extent in a client-side scripting language such as Asynchronous JavaScript and XML (AJAX), Flash® ActionScript, JavaScript, or Silverlight®. In some embodiments, a web application is written to some extent in a server-side coding language such as Active Server Pages (ASP), ColdFusion R, Perl, Java™, JavaServer Pages (JSP), Hypertext Preprocessor (PHP), Python™, Ruby, Tcl, Smalltalk, WebDNA®, or Groovy. In some embodiments, a web application is written to some extent in a database query language such as Structured Query Language (SQL). In some embodiments, a web application integrates enterprise server products such as IBM Lotus Domino®. In some embodiments, a web application includes a media player element. In various further embodiments, a media player element utilizes one or more of many suitable multimedia technologies including, by way of non-limiting examples, Adobe® Flash®, HTML 5, Apple® QuickTime®, Microsoft Silverlight®, Java™, and Unity®.

Figure 8:
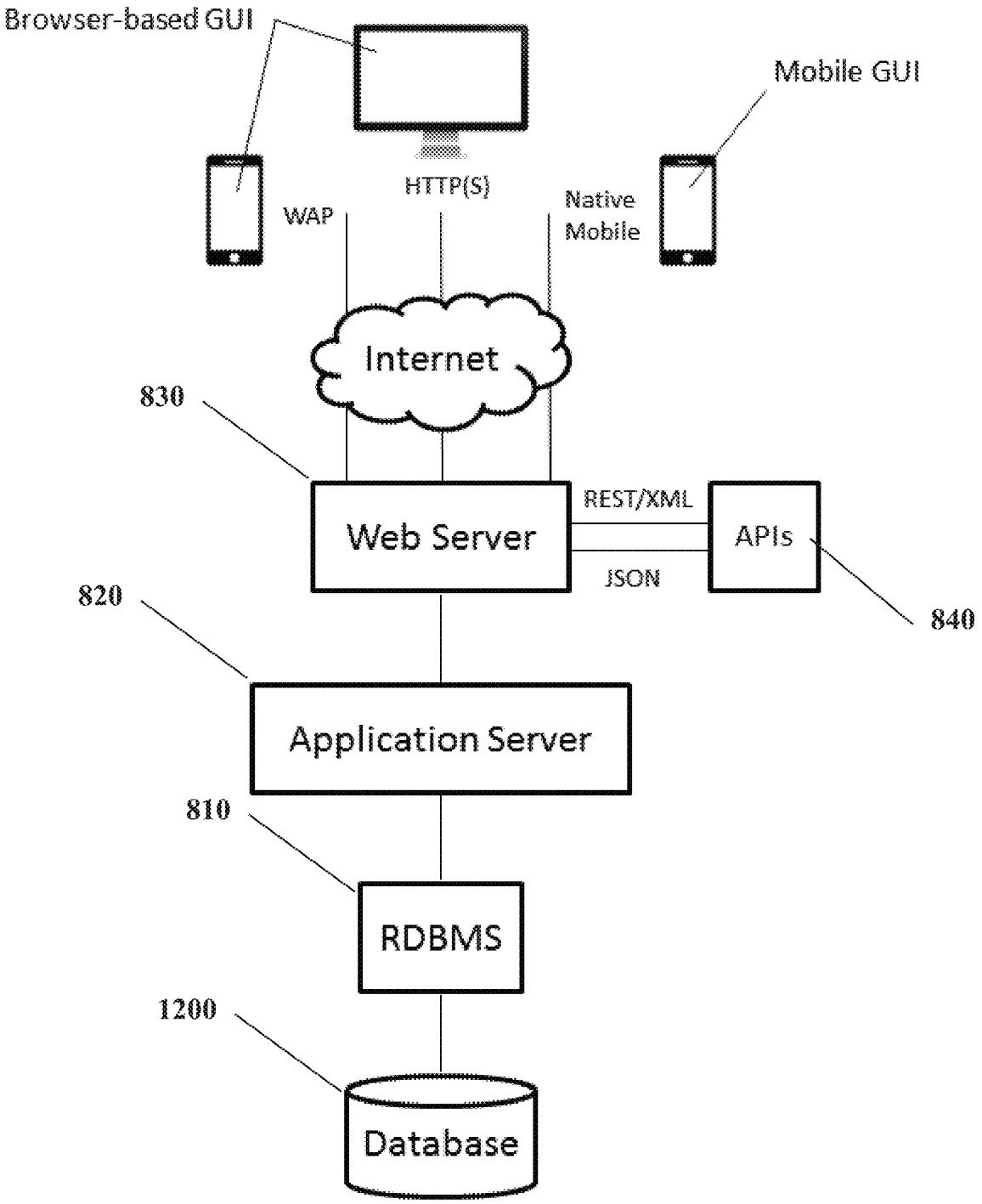
FIG. 8 shows a non-limiting example of a web/mobile application provision system; in this case, a system providing browser-based and/or native mobile user interfaces.

Referring to FIG. 8, in a particular embodiment, an application provision system comprises one or more databases 800 accessed by a relational database management system (RDBMS) 810. Suitable RDBMSs include Firebird, MySQL, PostgreSQL, SQLite, Oracle Database, Microsoft SQL Server, IBM DB2, IBM Informix, SAP Sybase, SAP Sybase, Teradata, and the like. In this embodiment, the application provision system further comprises one or more application severs 820 (such as Java servers, .NET servers, PHP servers, and the like) and one or more web servers 830 (such as Apache, IIS, GWS and the like). The web server(s) optionally expose one or more web services via app application programming interfaces (APIs) 840. Via a network, such as the Internet, the system provides browser-based and/or mobile native user interfaces.

Figure 9:
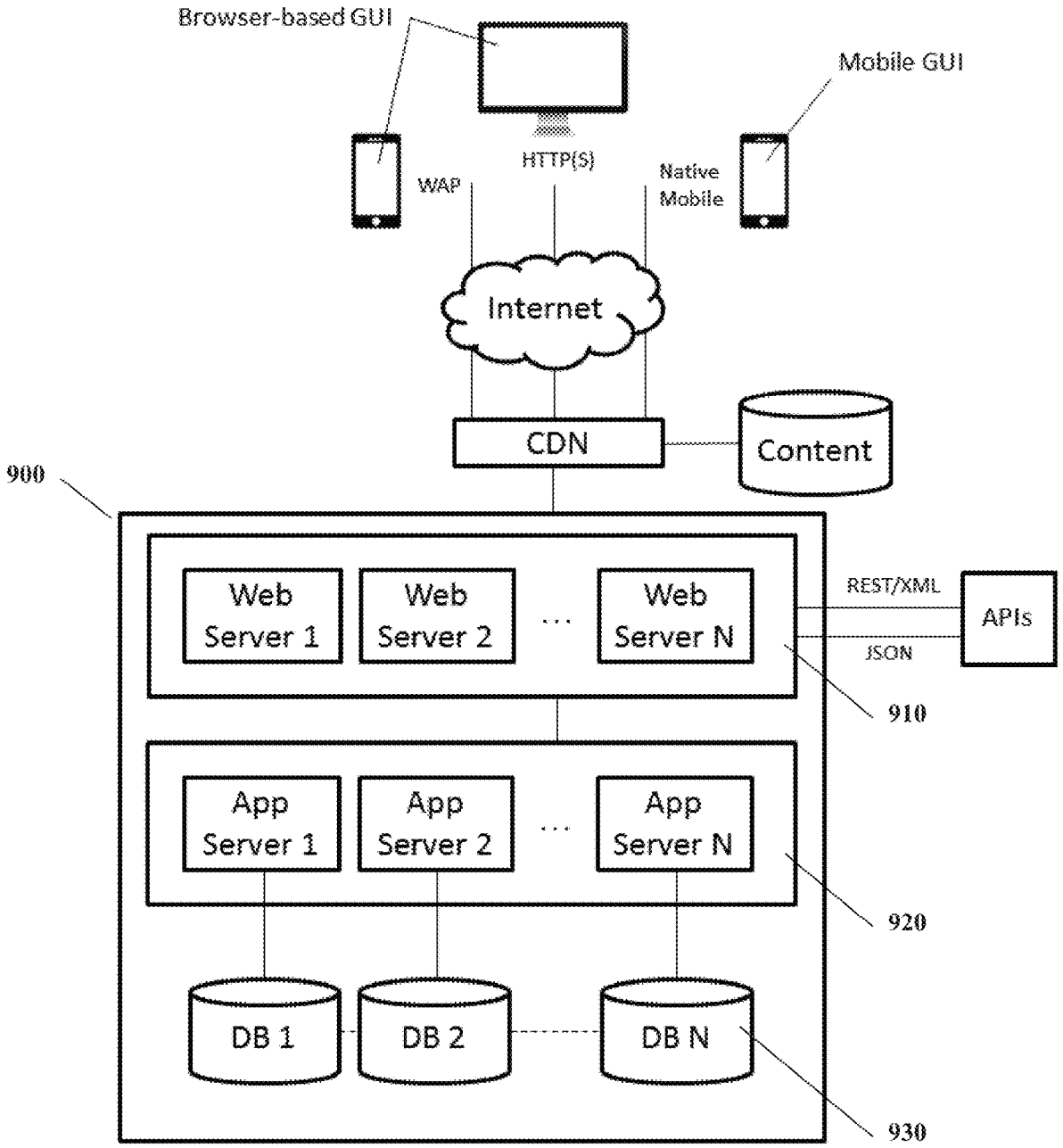
FIG. 9 shows a non-limiting example of a cloud-based web/mobile application provision system; in this case, a system comprising an elastically load balanced, auto-scaling web server and application server resources as well synchronously replicated databases.

Referring to FIG. 9, in a particular embodiment, an application provision system alternatively has a distributed, cloud-based architecture 900 and comprises elastically load balanced, auto-scaling web server resources 910 and application server resources 920 as well synchronously replicated databases 930.

Standalone Application

In some embodiments, a computer program includes a standalone application, which is a program that is run as an independent computer process, not an add-on to an existing process, e.g., not a plug-in. Those of skill in the art will recognize that standalone applications are often compiled. A compiler is a computer program(s) that transforms source code written in a programming language into binary object code such as assembly language or machine code. Suitable compiled programming languages include, by way of non-limiting examples, C, C++, Objective-C, COBOL, Delphi, Eiffel, Java™, Lisp, Python™, Visual Basic, and VB .NET, or combinations thereof. Compilation is often performed, at least in part, to create an executable program. In some embodiments, a computer program includes one or more executable complied applications.

Software Modules

In some embodiments, the platforms, systems, media, and methods disclosed herein include software, server, and/or database modules, or use of the same. In view of the disclosure provided herein, software modules are created by techniques known to those of skill in the art using machines, software, and languages known to the art. The software modules disclosed herein are implemented in a multitude of ways. In various embodiments, a software module comprises a file, a section of code, a programming object, a programming structure, or combinations thereof. In further various embodiments, a software module comprises a plurality of files, a plurality of sections of code, a plurality of programming objects, a plurality of programming structures, or combinations thereof. In various embodiments, the one or more software modules comprise, by way of non-limiting examples, a web application, a mobile application, and a standalone application. In some embodiments, software modules are in one computer program or application. In other embodiments, software modules are in more than one computer program or application. In some embodiments, software modules are hosted on one machine. In other embodiments, software modules are hosted on more than one machine. In further embodiments, software modules are hosted on a distributed computing platform such as a cloud computing platform. In some embodiments, software modules are hosted on one or more machines in one location. In other embodiments, software modules are hosted on one or more machines in more than one location.

Databases

In some embodiments, the platforms, systems, media, and methods disclosed herein include one or more databases, or use of the same. In view of the disclosure provided herein, those of skill in the art will recognize that many databases are suitable for storage and retrieval of spatial and construction information. In various embodiments, suitable databases include, by way of non-limiting examples, relational databases, non-relational databases, object-oriented databases, object databases, entity-relationship model databases, associative databases, and XML databases. Further non-limiting examples include SQL, PostgreSQL, MySQL, Oracle, DB2, and Sybase. In some embodiments, a database is internet-based. In further embodiments, a database is web-based. In still further embodiments, a database is cloud computing-based. In a particular embodiment, a database is a distributed database. In other embodiments, a database is based on one or more local computer storage devices.

While preferred embodiments of the present disclosure have been shown and described herein, it will be obvious to those skilled in the art that such embodiments are provided by way of example only. Numerous variations, changes, and substitutions will now occur to those skilled in the art without departing from the disclosure. It should be understood that various alternatives to the embodiments of the disclosure described herein may be employed in practicing the disclosure.

What is claimed is:

1. A computer-implemented method of controlling an earth-moving vehicle (EMV) including a blade, the method comprising:

(a) directing, by one or more computers, the EMV in a target region having a portion of soil to remove, wherein the blade is not touching the ground;

(b) detecting, by the one or more computers, one or more changes in a terrain of the target region;

(c) generating, by the one or more computers, a terrain map based at least in part on the one or more changes in the terrain;

(d) determining, by the one or more computers, a path for the EMV to traverse based at least in part on the terrain map;

(e) calculating, by the one or more computers, a target depth based at least in part on a target volume of soil, wherein the target volume of soil is equal to a product of the target depth, a width of the blade, and a target distance of cutting, and wherein the target distance of cutting includes a cut distance, a cut start point, and a cut end point for the EMV; and (f) dynamically adjusting, by the one or more computers, a depth of the blade as the EMV traverses the path to obtain the target volume of soil, wherein traversing the path comprises moving the EMV from the cut start point and the cut end point for a dry run.

2. The method of claim 1, wherein the terrain map includes a plurality of features comprising one or more elevations, angles, slopes, distances, and/or soils.

3. The method of claim 2, wherein detecting one or more changes comprises using a sensor to detect the plurality of features.

4. The method of claim 3, wherein the sensor comprises a light detection and ranging (LIDAR) detector mounted on the EMV.

5. The method of claim 4, wherein the sensor uses kinematics modeling to detect one or more blind spots of the LIDAR detector, and wherein the kinematics modeling comprises one or more of computations of angle, speed, terrain perception, or blade position.

6. The method of claim 3, wherein the sensor includes an inertial measurement unit (IMU).

7. The method of claim 2, wherein the terrain map is three-dimensional (3D).

8. The method of claim 1, wherein generating the terrain map comprises generating a piecewise linear function of the target region.

9. The method of claim 8, wherein the piecewise linear function includes a two-dimensional (2D) representation of the target region, and wherein the 2D representation corresponds to an x-direction and a z-direction of the terrain.

10. The method of claim 9, wherein the x-direction represents a lateral movement from a cut start point to a cut end point, and wherein the z-direction represents a vertical movement from the cut start point to the cut end point.

11. The method of claim 10, wherein the piecewise linear function includes one or more angles between a plurality of slopes of the terrain.

12. The method of claim 8, wherein generating the terrain map comprises approximating one or more features of the terrain, wherein the piecewise linear function comprises a plurality of linear pieces that are connected to one another, and wherein approximating the one or more features comprises setting a length of the pieces to a predetermined length.

13. The method of claim 1, wherein traversing the path comprises moving the EMV from the cut end point to the cut start point after the dry run, wherein determining the path comprises determining the target depth of the blade at each of a plurality of points between the cut start point and the cut end point.

14. The method of claim 1, wherein traversing the path comprises moving the EMV along one or more elevations and/or one or more slopes of the target region.

15. The method of claim 1, further comprising:

(a) determining, by the one or more computers, that a volume of soil in the blade is at capacity before the EMV has traversed the path;

(b) directing, by the one or more computers, the EMV to raise its blade above the ground at break point; and (c) directing, by the one or more computers, the EMV away from the path to remove the soil from the blade.

16. The method of claim 15, further comprising:

(a) directing, by the one or more computers, the EMV back to move to the break point after removing the soil from the blade;

(b) determining, by the one or more computers, a remainder of the path for the EMV to traverse to remove the soil; and (c) directing, by the one or more computers, the EMV to resume dynamic adjustment of the depth of the blade until a cut point is reached.

17. A computer-implemented method of controlling an earth-moving vehicle (EMV) including a blade, the method comprising:

(a) directing, by one or more computers, the EMV in a target region having a portion of soil to remove, wherein the blade is not touching the ground;

(b) detecting, by the one or more computers, one or more changes in a terrain of the target region;

(c) generating, by the one or more computers, a terrain map based at least in part on the one or more changes in the terrain, wherein generating the terrain map comprises generating a piecewise linear function of the target region, wherein the piecewise linear function includes a two-dimensional (2D) representation of the target region, and wherein the 2D representation corresponds to an x-direction and a z-direction of the terrain;

(d) determining, by the one or more computers, a path for the EMV to traverse based at least in part on the terrain map; and (e) dynamically adjusting, by the one or more computers, a depth of the blade as the EMV traverses the path to obtain the target volume of soil.

18. A computer-implemented method of controlling an earth-moving vehicle (EMV) including a blade, the method comprising:

(a) directing, by one or more computers, the EMV in a target region having a portion of soil to remove, wherein the blade is not touching the ground;

(b) detecting, by the one or more computers, one or more changes in a terrain of the target region;

(c) generating, by the one or more computers, a terrain map based at least in part on the one or more changes in the terrain, wherein generating the terrain map comprises generating a piecewise linear function of the target region, wherein generating the terrain map comprises approximating one or more features of the terrain, wherein the piecewise linear function comprises a plurality of linear pieces that are connected to one another, and wherein approximating the one or more features comprises setting a length of the pieces to a predetermined length;

(d) determining, by the one or more computers, a path for the EMV to traverse based at least in part on the terrain map; and (e) dynamically adjusting, by the one or more computers, a depth of the blade as the EMV traverses the path to obtain the target volume of soil.

* * * * *